US008516928B2

(12) United States Patent
Hu

(10) Patent No.: US 8,516,928 B2
(45) Date of Patent: Aug. 27, 2013

(54) RATCHET WRENCH PREVENTING JAM OF PAWLS

(76) Inventor: Bobby Hu, Taichung (TW)

( * ) Notice: Subject to any disclaimer, the term of this patent is extended or adjusted under 35 U.S.C. 154(b) by 16 days.

(21) Appl. No.: 13/369,387

(22) Filed: Feb. 9, 2012

(65) Prior Publication Data

US 2013/0145906 A1 Jun. 13, 2013

(30) Foreign Application Priority Data

Dec. 13, 2011 (TW) ..... 100146006 A

(51) Int. Cl.
*B25B 13/46* (2006.01)

(52) U.S. Cl.
USPC ..... 81/63.1; 81/60; 81/61; 81/62; 81/63.2

(58) Field of Classification Search
USPC ..... 81/60–63.2
See application file for complete search history.

(56) References Cited

U.S. PATENT DOCUMENTS

| | | | | |
|---|---|---|---|---|
| 6,981,434 | B2 | 1/2006 | Chen | 81/63.1 |
| 7,124,664 | B1 * | 10/2006 | Lee | 81/63.1 |
| 7,921,751 | B2 * | 4/2011 | Hu | 81/63.1 |
| 7,987,747 | B2 * | 8/2011 | Ross et al. | 81/63.1 |

* cited by examiner

*Primary Examiner* — Lee D Wilson
*Assistant Examiner* — Danny Hong
(74) *Attorney, Agent, or Firm* — Alan Kamrath; Kamrath IP Lawfirm, P.A.

(57) ABSTRACT

A ratchet wrench includes a head having a first compartment rotatably receiving a drive member. A second compartment is defined in an inner periphery of the first compartment and receives first and second pawls. A switch is pivotably mounted in a control groove of the head and controls engagement relations between the first and second pawls and the drive member. A limiting member is connected between the first and second pawls and maintains two closest teeth respectively of first and second toothed sections of the first and second pawls to be in a restraining spacing that is smaller than a jam spacing, preventing the first and second pawls from jamming between the drive member and a wall of the second compartment.

13 Claims, 13 Drawing Sheets

RATCHET WRENCH PREVENTING JAM OF PAWLS

BACKGROUND OF THE INVENTION

The present invention relates to a ratchet wrench and, more particularly, to a ratchet wrench preventing jam of pawls.

U.S. Pat. No. 6,981,434 discloses a wrench including a head having a through-hole receiving an engaging wheel. A recess is defined in an inner periphery of the through-hole and receives two pawls that can be actuated by a control member. The control member can change the positions of the pawls so that one of the pawls can engage with the engaging wheel to allow the engaging wheel to rotate in a single direction relative to the wrench, as shown in FIGS. 3, 6, and 7 of U.S. Pat. No. 6,981,434.

However, the wrench having two pawls of this type encounters difficulties in processing. With reference to FIG. 10 showing a portion of a wrench based on U.S. Pat. No. 6,981,434, the wrench 90 includes a head 90 having a through-hole 91 receiving an engaging wheel 92. A recess 93 is in communication with through-hole 91 and receives two pawls 93.

Offset of the recess 93 relative to through-hole 91 often occurs due to errors during processing of recess 93. Specifically, through-hole 93 defines a rotating axis CL about which engaging wheel 92 rotates. Recess 93 includes crescent cross sections having a central axis P0 that is preferably located on a reference line Y extending through rotating axis CL and spaced from another reference line X extending through rotating axis CL. However, the outer diameter of the cutter for processing recess 93 wears after processing a number of wrenches. The diameter of the new cutter is larger than that of the old cutter. As a result, recesses 93 of some wrenches are larger than others after processing.

Besides the above problem, each factor, including setting of the coordinate of the cutter, temperature control of the cutter and the wrench, the position of a clamp for clamping wrench 90, etc., affects the location of recess 93 of each wrench 90 after processing, such that processing errors occur easily. FIG. 10 shows central axes P1 and P2 of recess 93 offsetting from ideal central axis P0 along reference line Y and shows central axes P3 and P4 of the recess 93 offsetting from ideal central axis P0 along reference axis X.

The processing errors causing offsetting of recess 93 also result in poor engagement of pawls 94 with engaging wheel 92, leading to jam of pawls 94 between engaging wheel 92 and a wall of recess 93 such that both pawls 94 can not be moved. As a result, the product defect rate resulting from these processing errors can not be reduced, failing to meet the requirements of the market.

FIG. 10 shows wrench 90 in a natural position not engaged with a fastener, wherein pawls 94 are not moved, and the wall of recess 93 does not deform. A spring 95 biases left pawl 94 to press against a left wall section of recess 93 and to engage with engaging wheel 92. Spring 95 also biases right pawl 94 to press against a right wall section of recess 93 and to engage with engaging wheel 92. Nevertheless, both pawls 94 can still be disengaged from engaging wheel 92. In this case, pawls 94 are in a stable state in which two closest teeth respectively of pawls 94 have a safety spacing D1 therebetween. This is the ideal state of pawls 94.

In fact, the engagement between pawls 94 and engaging wheel 92 of a wrench 90 differs from that in another wrench 90 due to the processing errors. Wrenches 90 with poor engagement become defective. All of these result from the differing sizes or offsetting of recesses 93. FIGS. 11-13 show jam of pawls 94 due to offsetting from ideal central axis P0 to central axis P1 or P2.

With reference to FIG. 11, when wrench 90 is rotated counterclockwise to tighten a fastener 80, the reactive force from fastener 80 causes engaging wheel 92 to actuate left pawl 94 and to press against the left wall section of recess 93, causing deformation of the left wall surface 83. At this time, right pawl 94 gradually disengages from engaging wheel 92. With reference to FIG. 12, when the teeth of right pawl 94 are pushed outward by spring 95 and slip across the crests of the teeth of engaging wheel 92, spring 95 pushes right pawl 94 away from left pawl 94, such that right pawl 94 is moved through a distance equal to a tooth spacing between two adjacent crests of right pawl 94. With reference to FIG. 13, right pawl 94 is moved into and jams in a right corner of recess 93. At this time, left pawl 94 is pushed by the reactive force from the left wall section of recess 93, and this reactive force is transmitted through engaging wheel 92 to right pawl 94, such that right pawl 94 tightly presses against the right wall section of recess 93. As a result, both of left and right pawls 94 jam and, thus, can not be disengaged from engaging wheel 92. In this jammed state, the two closest teeth respectively of pawls 94 have a jam spacing D2 therebetween larger than safety spacing D1.

In an attempt to solve jam of pawls 94 by increasing the precision of the processing, the costs are significantly increased and not acceptable on the market. Furthermore, jam of pawls 94 also occurs due to other factors such as processing errors or positioning errors.

Thus, a need exists for a novel wrench capable of preventing jam of the pawls.

BRIEF SUMMARY OF THE INVENTION

The present invention solves this need and other problems in the field of prevention of jam of pawls of ratchet wrenches by providing, a ratchet wrench including a body having a head with an inner periphery defining a first compartment. A second compartment is defined in the inner periphery of the head. The head includes a control groove in communication with the second compartment. A drive member is rotatably received in the first compartment of the head and includes an annular toothed portion formed on an outer periphery thereof. The drive member is adapted to drive a fastener to rotate. A pawl device is mounted in the second compartment of the head. The pawl device is selectively engageable with the drive member in either of first and second engagement relations corresponding to first and second driving directions of the ratchet wrench driving the fastener. The pawl device includes first and second pawls and an elastic element mounted between the first and second pawls, with the elastic element biasing the first and second pawls away from each other. The first pawl includes a first toothed section engageable with the toothed portion of the drive member under bias of the elastic element. The second pawl includes a second toothed section engageable with the toothed portion of the drive member under the bias of the elastic element. The pawl device is movable between a stable state in which the first and second toothed sections of the first and second pawls are disengageable from the toothed portion of the drive member and a jammed state in which the first and second toothed sections of the first and second pawls jam between the toothed portion of the drive member and a wall of the second compartment. Two closest teeth respectively of the first and second toothed sections have a safety spacing therebetween when the pawl device is in the stable state. The two closest teeth respectively of the first and second toothed sections have a jam spacing therebetween when the pawl device is in the jammed state.

The ratchet wrench further includes a switch pivotably mounted in the control groove and operatively connected to the pawl device. The switch controls the pawl device to be in one of the first and second engagement relations with the drive member. A limiting member is connected between the first and second pawls to maintain the two closest teeth respectively of the first and second toothed sections to be in a restraining spacing that is smaller than the jam spacing, preventing the pawl device from the jammed state.

Preferably, the limiting member includes a first limiting portion connected to a first follower portion of the first pawl. The limiting member further includes a second limiting portion connected to a second follower portion of the second pawl.

Preferably, the limiting member includes a sliding groove having first and second ends respectively forming the first and second limiting portions. The first and second follower portions of the first and second pawls are slideably received in the sliding groove.

When the first follower portion of the first pawl actuates the first limiting portion of the limiting member and causes movement of the limiting member, the second limiting portion of the limiting member actuates the second follower portion of the second pawl to cause movement of the second pawl, maintaining the two closest teeth respectively of the first and second toothed sections to be in the restraining spacing without driving the switch.

Preferably, the limiting member further includes a stop between the first and second ends of the sliding groove.

Preferably, the restraining spacing is equal to or larger than the safety spacing.

Preferably, the switch is movable between first, second, and third positions. The switch includes a first actuating portion and a second actuating portion. When the switch is moved to the first position, the first pawl is moved by the first actuating portion to disengage from the drive member, the second pawl is engaged with the drive member, and the pawl device is in the first engagement relation with the drive member. When the switch is moved to the second position, the second pawl is moved by the second actuating portion to disengage from the drive member, the first pawl is engaged with the drive member, and the pawl device is in the second engagement relation with the drive member. When the switch is in the third position, the first and second pawls are engaged with the drive member, the pawl device is in a third engagement relation to the drive member, and the drive member and the head rotate jointly in either of the first and second driving directions.

Preferably, the wall of the second compartment includes first and second abutment faces adjacent to the first compartment and located at two sides of the second compartment. When the switch is in the third position, the elastic element biases the first pawl to press against the first abutment face and to engage with the drive member. The elastic element also biases the second pawl to press against the second abutment face and to engage with the drive member, and the first and second pawls are disengageable from the drive member.

In an example, the control groove is located in an end of the second compartment away from the first compartment. The first actuating portion of the switch selectively actuates the first follower portion of the first pawl. The second actuating portion of the switch selectively actuates the second follower portion of the second pawl. An open section is formed between the first and second actuating portions. When the switch is in the third position, the first follower portion of the first pawl and the second follower portion of the second pawl are received in the open section of the switch, and the first and second pawls are engaged with the drive member, preventing the drive member from rotating relative to the head of the body.

In another example, the control groove surrounds and is in communication with the first compartment. The switch is annular and hollow and includes an axial hole rotatably receiving the drive member. The switch is pivotable relative to the drive member. The first pawl includes a first push face, and the second pawl includes a second push face. The first actuating portion of the switch selectively actuates the first push face of the first pawl. The second actuating portion of the switch selectively actuates the second push face of the second pawl. An open section is formed between the first and second actuating portions. When the switch is in the third position, the first push face of the first pawl and the second push face of the second pawl are received in the open section of the switch, and the first and second pawls are engaged with the drive member, preventing the drive member from rotating relative to the head of the body.

Preferably, a positioning device is provided between the switch and the body. The switch includes a plurality of positioning portions. The body further includes a groove receiving the positioning device. The positioning device includes an elastic member received in the groove and a positioning member between the elastic member and the switch. The elastic member biases the positioning member to be selectively engaged with one of the plurality of positioning portions of the switch.

Preferably, the head includes a first side and a second side parallel to the first side and spaced from the first side along a rotating axis. The first compartment extends from the first side through the second side along the rotating axis. The drive member is rotatable relative to the head about the rotating axis.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
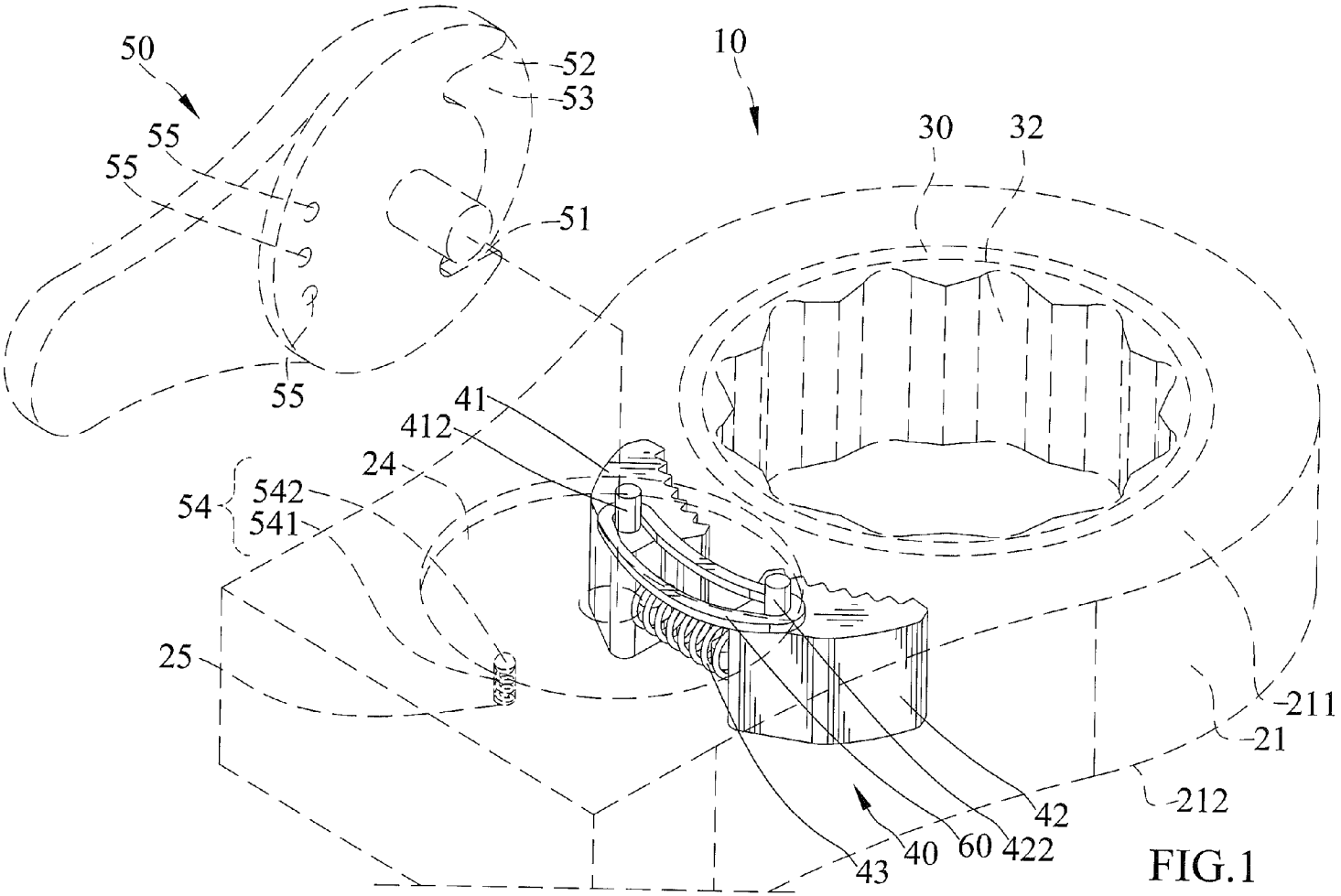
FIG. 1 shows a partial, exploded, perspective view of a ratchet wrench of a first embodiment according to the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "top", "inner", "outer", "side", "end", "portion", "section", "longitudinal", "circumferential" "annular", "spacing", "counterclockwise", "thickness", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
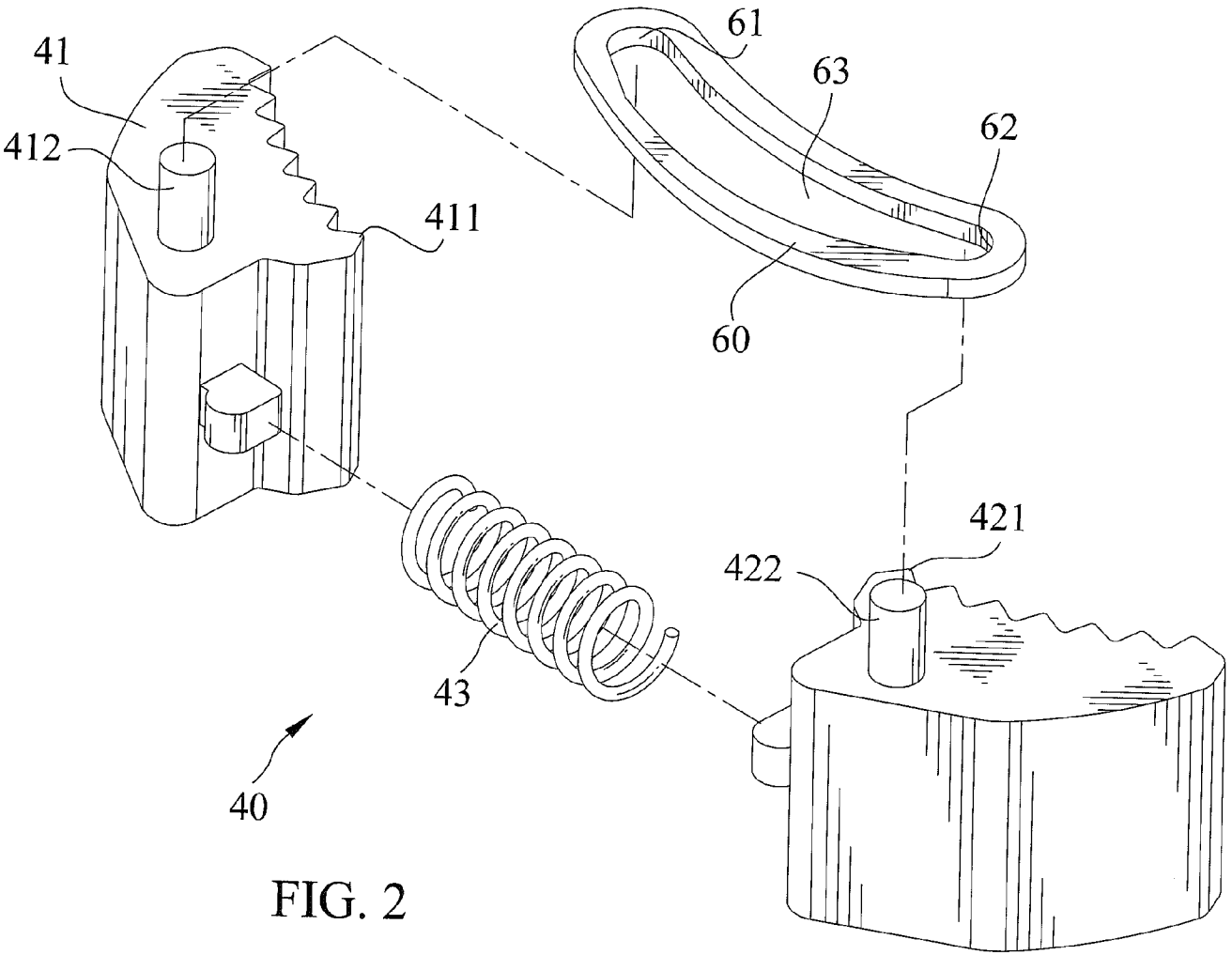
FIG. 2 shows an exploded, perspective view of a pawl device and a limiting member of the ratchet wrench of FIG. 1.
Figure 3:
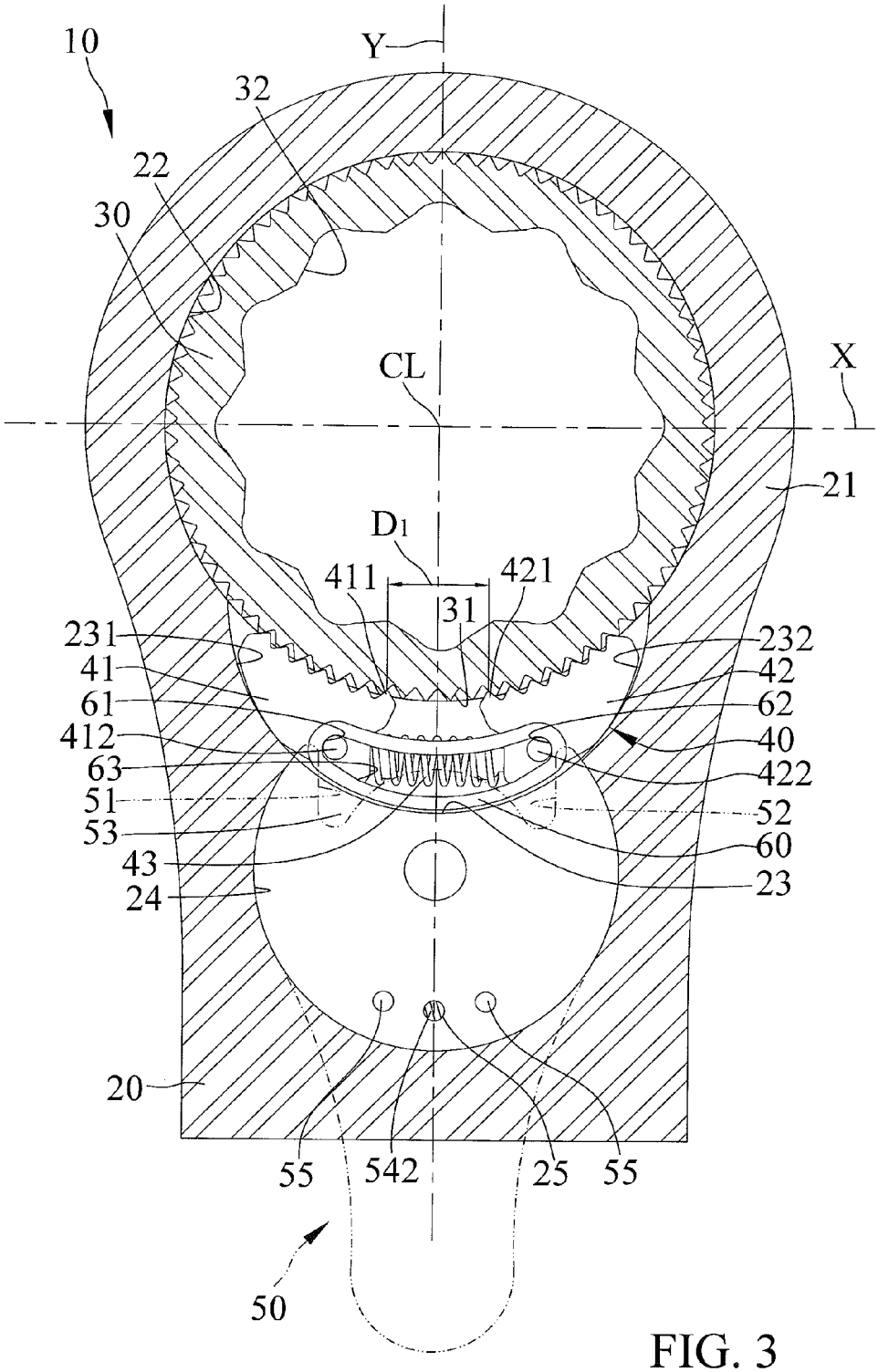
FIG. 3 shows a cross sectional view of the ratchet wrench of FIG. 1, with the pawl device in a stable state.

With reference to FIGS. 1-3, a ratchet wrench 10 of a first embodiment according to the present invention includes a body 20, a drive member 30, a pawl device 40, a switch 50, and a limiting member 60. Limiting member 60 prevents pawl device 40 from jamming between drive member 30 and body 20, effectively avoiding pawl device 40 from the jammed sate.

Body 20 includes a head 21 defining a rotating axis CL. A user can rotate body 20 so that head 21 rotates about rotating axis CL. Head 21 includes parallel, first and second sides 211 and 212 spaced along rotating axis CL. Head 21 further includes a first compartment 22 extending from first side 211 through second side 212 along rotating axis CL and having circular cross sections. A second compartment 23 is defined in an inner periphery of first compartment 22 and is crescent in cross section. A central axis of second compartment 23 is parallel to rotating axis CL. Second compartment 23 includes a wall having first and second abutment faces 231 and 232 adjacent to first compartment 22 and located at two sides of second compartment 23. Head 21 further includes a control groove 24. In this embodiment, control groove 24 is located in an end of second compartment 23 away from first compartment 22.

Drive member 30 is received in first compartment 22 of head 21 and rotatable relative to head 21 about rotating axis CL. Drive member 30 includes an annular toothed portion 31 on an outer periphery thereof. Toothed portion 31 is received in first compartment 22 of head 21 and includes a plurality of teeth, with a tooth spacing defined between two adjacent crests. Drive member 30 includes a driving portion 32 for driving a fastener to rotate. In this embodiment, driving portion 32 includes a polygonal hole.

Pawl device 40 is mounted in second compartment 23 of body 20 and selectively engageable with drive member 30 in one of first, second, and third engagement relations. The first ands second engagement relations correspond to two driving directions of ratchet wrench 10 driving a fastener 80. Drive member 30 can not rotate relative to head 21 when pawl device 40 is in the third engagement relation with drive member 30.

Pawl device 40 includes first and second pawls 41 and 42 and an elastic element 43 mounted between first and second pawls 41 and 42. Elastic element 43 biases first and second pawls 41 and 42 away from each other and respectively towards two sides of second compartment 23. First pawl 41 includes a first toothed section 411 facing first compartment 22 and having a plurality of teeth. First toothed section 411 is engageable with toothed portion 31 of drive member 30 under the bias of elastic element 43. First pawl 41 further includes a side having a first follower portion 412 in the form of a cylinder in this embodiment. Second pawl 42 includes a second toothed section 421 facing first compartment 22 and having a plurality of teeth. Second toothed section 421 is engageable with toothed portion 31 of drive member 30 under the bias of elastic element 43. Second pawl 42 further includes a side having a second follower portion 422 in the form of a cylinder in this embodiment.

With reference to FIG. 3, when ratchet wrench 10 is in a natural state not engaged with fastener 80 and when first and second pawls 41 and 42 are not moved, elastic element 43 biases first pawl 41 to press against first abutment face 231 and to engage with drive member 30, and the wall of second compartment 23 is not deformed. At the same time, elastic element 43 biases second pawl 42 to press against second abutment face 232 and to engage with drive member 30. First and second pawls 41 and 42 are still disengageable from drive member 30. Thus, pawl device 40 is in a stable state in which two closest teeth respectively of first and second toothed sections 411 and 412 have a safety spacing D1 therebetween. In this embodiment, safety spacing D1 is not smaller than four times the tooth spacing but smaller than five times the tooth spacing.

Figure 13:
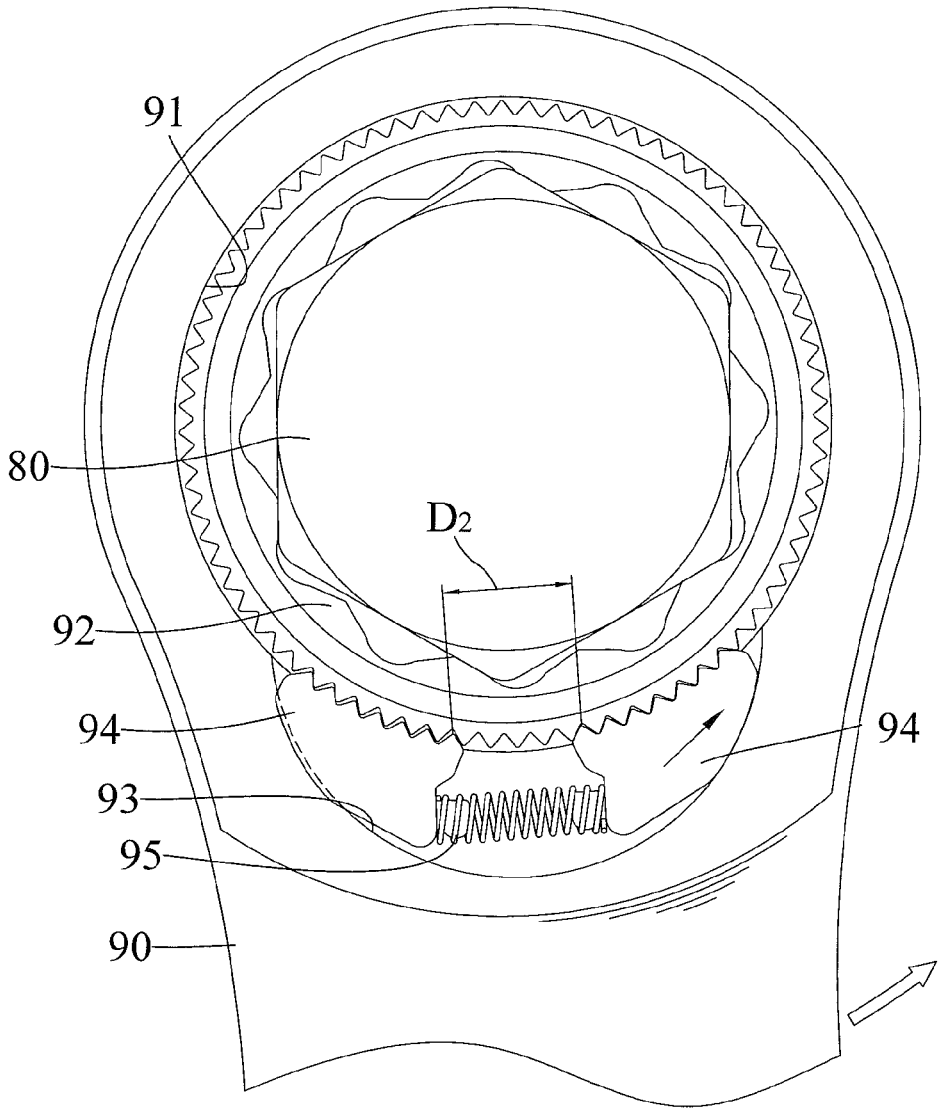
FIG. 13 PRIOR ART
FIG. 13 shows a view similar to FIG. 12, with the left and right pawls in a jammed state.

When drive member 30 actuates first pawl 41 to press against first abutment face 231 and causes deformation of the wall of second compartment 23, if elastic element 43 biases first pawl 41 to press against first abutment face 231 and to engage with drive member 30 and biases second pawl 42 to press against second abutment face 232 and to engage with drive member 30 such that first and second pawls 41 and 42 can not disengage from drive member 30, pawl device 40 is in a jammed state in which the two closest teeth respectively of first and second toothed sections 411 and 412 have a jam spacing D2 (see FIG. 13) therebetween. Jam spacing D2 is larger than safety spacing D1.

Switch 50 is pivotably mounted in control groove 24 and operatively connected to pawl device 40 to control the engagement relation between pawl device 40 and drive member 30. Switch 50 is movable between first, second, and third positions. When switch 50 is in the first position, first pawl 41 is disengaged from drive member 30, and second pawl 42 is engaged with drive member 30. When switch 50 is in the second position, second pawl 42 is disengaged from drive member 30, and first pawl 41 is engaged with drive member 30. When drive member 30 is in the third position, first and second pawls 41 and 42 are engaged with drive member 30.

Switch 50 includes first and second actuating portions 51 and 52 extending into second compartment 23 to control pawl device 40 in second compartment 23. When switch 50 is pivoted to the first position, first pawl 41 is moved by first actuating portion 51 to disengage from drive member 30. In this case, pawl device 40 is in the first engagement relation with drive member 30, and head 21 can rotate together with drive member 30 in a first driving direction and can rotate freely relative to drive member 30 in a second driving direction opposite to the first driving direction. When switch 50 is pivoted to the second position, second pawl 42 is moved by second actuating portion 52 to disengage from drive member 30. In this case, pawl device 40 is in the second engagement relation with drive member 30, and head 21 can rotate together with drive member 30 in the second driving direction and can rotate freely relative to drive member 30 in the first driving direction.

An open section 53 is formed between first and second actuating portions 51 and 52. When switch 50 is in the third position, first follower portion 412 of first pawl 41 and second follower portion 422 of second pawl 42 are received in open section 53 of switch 50. First and second pawls 41 and 42 are both engaged with drive member 30, preventing drive member 30 from rotating relative to head 21. Thus, body 20 can be rotated to jointly rotate driving portion 30 of drive member 30 and head 21 in either of the first and second driving directions.

A positioning device 54 is provided between switch 50 and body 20. Switch 50 includes a plurality of positioning portions 55 corresponding to the location of positioning device 54. Positioning device 54 can be selectively retained in one of positioning portions 55 to retain switch 50 in place. Positioning device 54 includes an elastic member 541 received in a groove 25 of body 20 and a positioning member 542 between elastic member 541 and switch 50. Elastic member 541 biases positioning member 542 to be selectively engaged with one of positioning portions 55 of switch 50. Positioning member 542 is in the form of a ball in this embodiment.

Figure 4A:
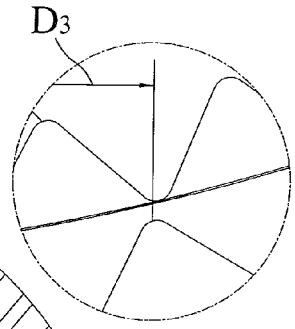
FIG. 4A shows an enlarged view of a circled portion of FIG. 4.
Figure 4:
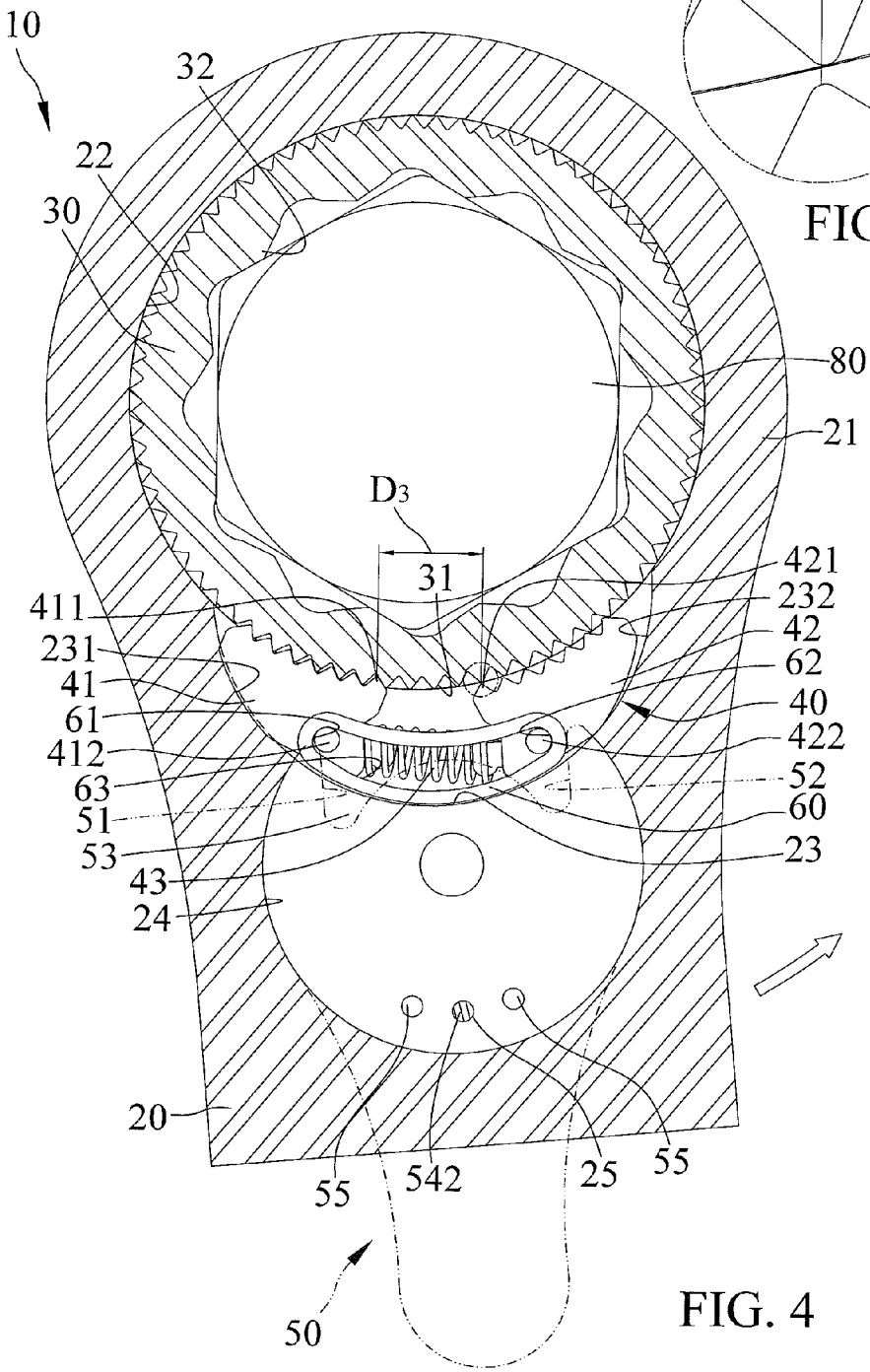
FIG. 4 shows a cross sectional view of the ratchet wrench of FIG. 1, with the limiting member keeping two closest teeth respectively of two pawls of the pawl device to be within a stuck tooth number spacing.

Limiting member 60 comprising a loop which is connected to first and second pawls 41 and 42 and maintains the two closest teeth respectively of first and second toothed sections 411 and 421 to be in a restraining spacing D3 (FIG. 4). Restraining spacing D3 is smaller than jam spacing D2. Thus, first and second pawls 41 and 42 will not jam between drive member 30 and the wall of second compartment 23 at the same time, effectively preventing pawl device 40 from the jammed state. Specifically, even if processing errors exist in first and second compartments 22 and 23, pawl device 40 is prevented from jamming by provision of limiting member 60. This increases the yield of qualified products without incurring the high costs required by precision processing, meeting the demands of the market. More specifically, restraining spacing D3 is equal to or larger than safety spacing D1, maintaining pawl device 40 in the stable state.

Limiting member 60 includes first and second limiting portions 61 and 62 respectively at two sides of limiting member 60. First limiting portion 61 is connected to first follower portion 412 of first pawl 41, and second limiting portion 62 is connected to second follower portion 422 of second pawl 42. This assures restraining spacing D3 between first and second pawls 41 and 42 to be smaller than jam spacing D2.

In this embodiment, limiting member 60 includes a sliding groove 63 having first and second ends respectively forming first and second limiting portions 61 and 62. First and second follower portions 412 and 422 are slideably received in sliding groove 63.

When first actuating portion 412 of first pawl 41 actuates first limiting portion 61 of limiting member 60 to move jointly, second limiting portion 62 of limiting member 60 actuates second follower portion 422 of second pawl 42 and, thus, cause movement of second pawl 42 without moving switch 50. By such an arrangement, jam of pawl device 40 is avoided even if errors exist in processing or positioning of switch 50.

With reference to FIG. 4, when body 20 is rotated in a counterclockwise direction to drive a tightened fastener 80 while switch 50 is in the third position, the reactive force from fastener 80 causes drive member 30 to actuate first pawl 41 to press against first abutment face 231 of second compartment 23, causing deformation of first abutment face 231. First limiting portion 61 of limiting member 60 is actuated by first follower portion 412 to move together with first pawl 41. At the same time, second limiting portion 62 of limiting member 60 actuates second follower portion 422 of second pawl 42, causing movement of second pawl 42 without moving switch 50. Thus, second pawl 42 is disengaged from toothed portion 31 of drive member 30.

Since restraining spacing D3 is smaller than jam spacing D2, limiting member 60 prevents simultaneous jam of first and second pawls 41 and 42 between drive member 30 and the wall of second compartment 23, effectively avoiding pawl device 40 from the jammed state. Thus, the wall of second compartment 23 restitutes to its original shape shown in FIG. 3 when body 20 is not rotated. Elastic element 43 biases first pawl 41 to press against first abutment face 231 and to engage with drive member 30 and biases second pawl 42 to press against second abutment face 232 and to engage with drive member 30. Nevertheless, first and second pawls 41 and 42 are disengageable from drive member 30. Pawl device 40 is returned to the stable state.

Figure 5:
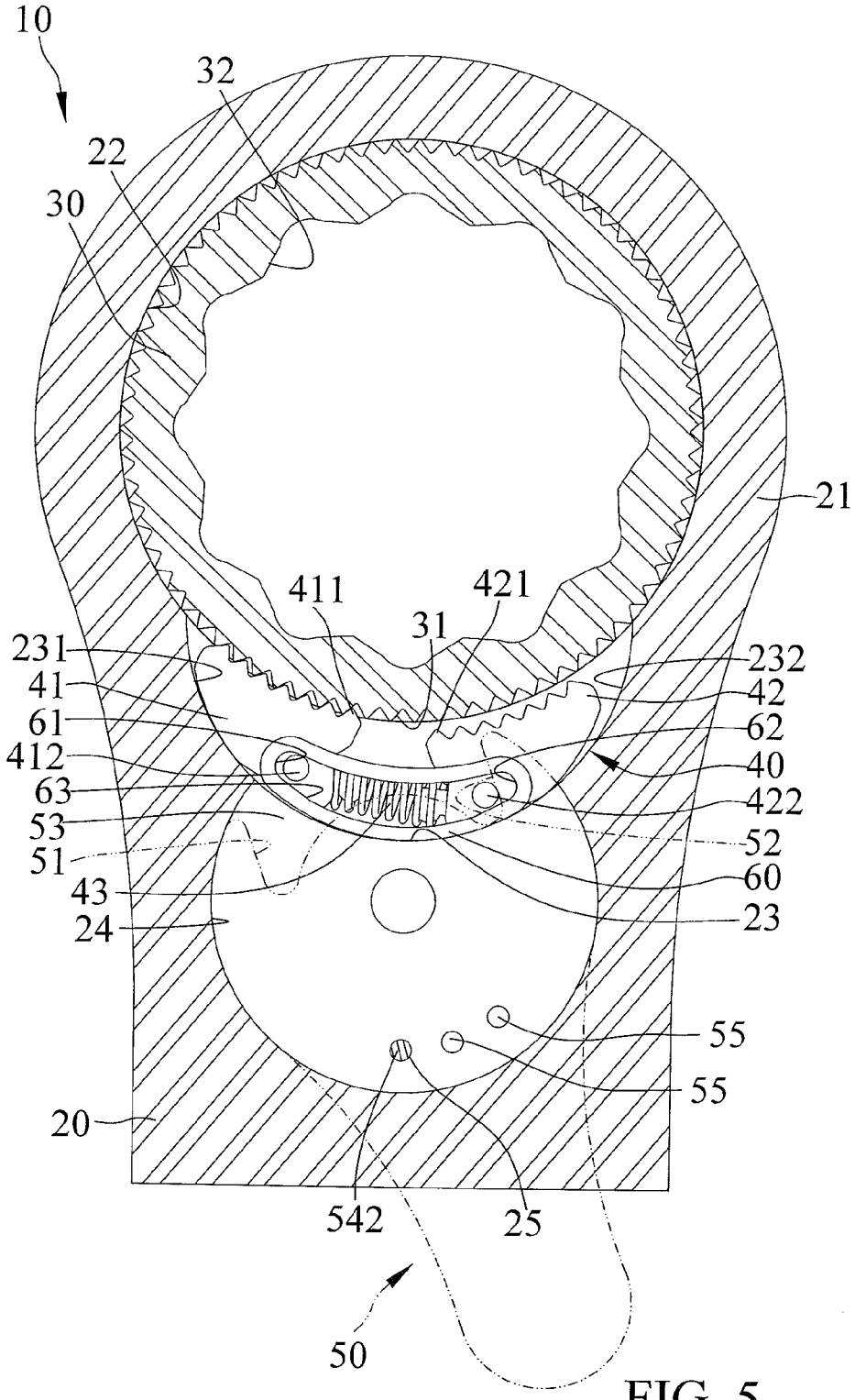
FIG. 5 shows a cross sectional view similar to FIG. 3, with a switch moved to another position.
Figure 6:
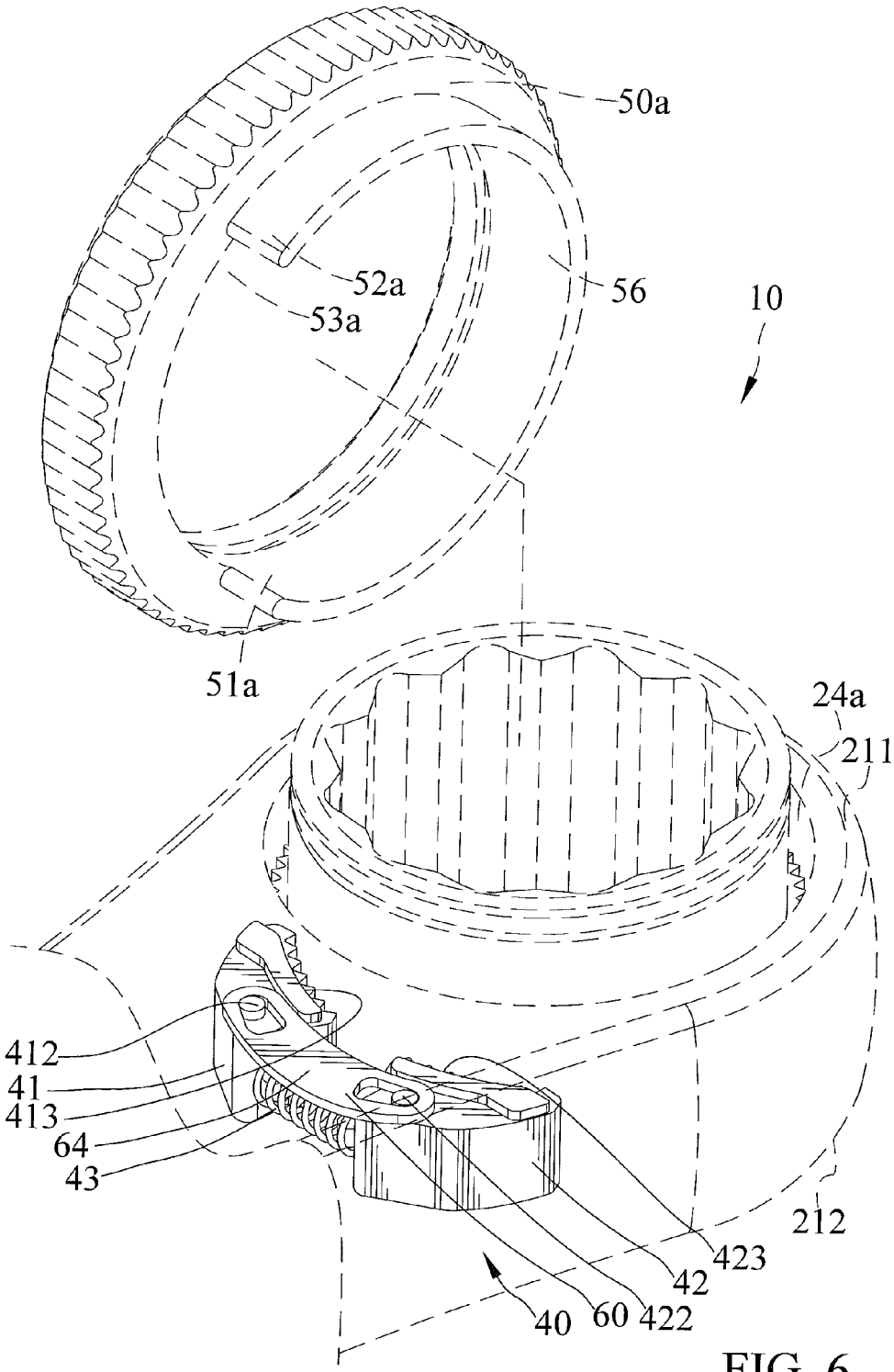
FIG. 6 shows a partial, exploded, perspective view of a ratchet wrench of a second embodiment according to the present invention.
Figure 7:
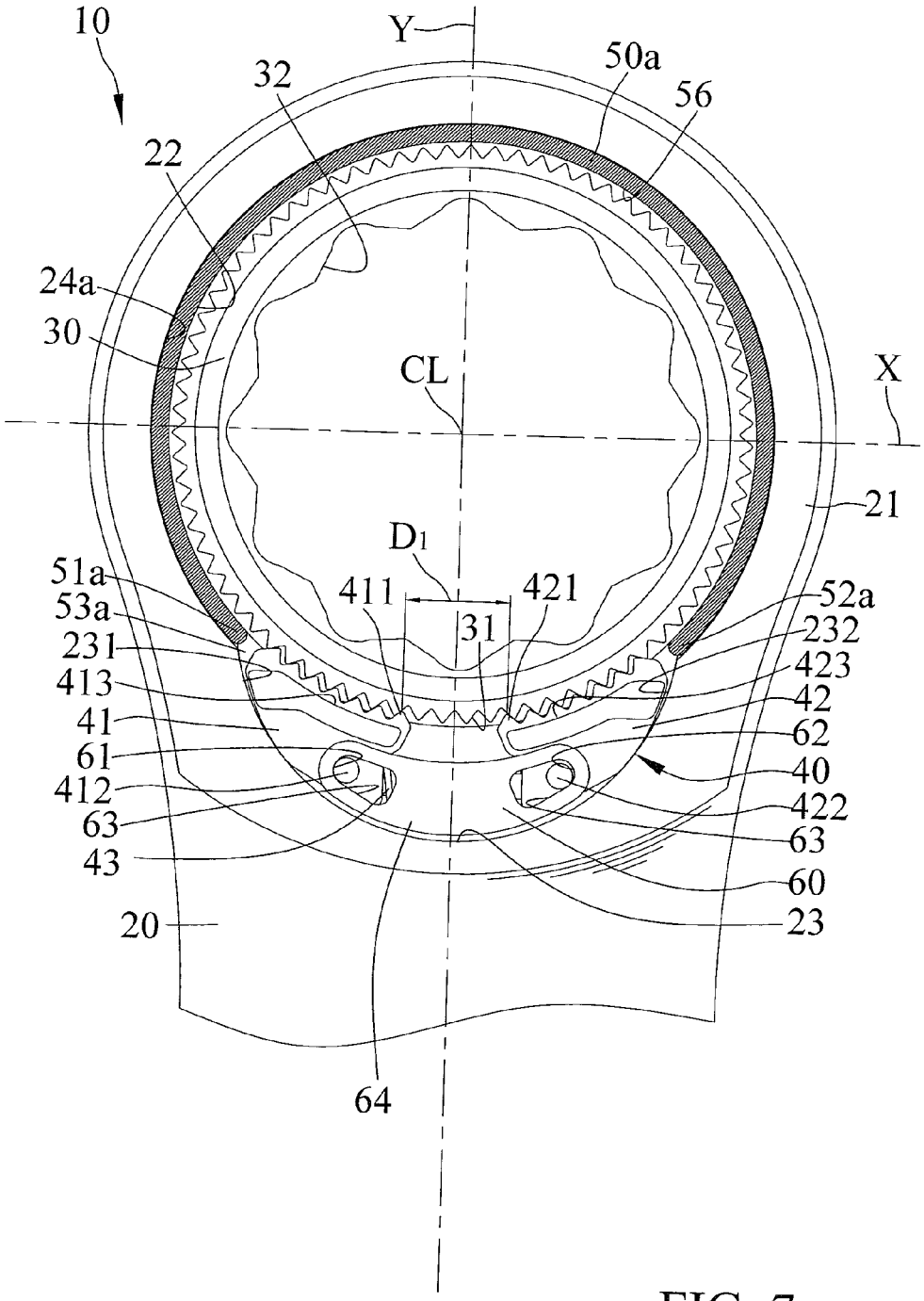
FIG. 7 shows a cross sectional view of the ratchet wrench of FIG. 6, with the pawl device in a stable state.

With reference to FIG. 5, switch 50 can be pivoted to change the positions of first and second pawls 40 when pawl device 40 is in the stable state, effectively avoiding jam resulting from processing errors.

FIGS. 6-9 show a second embodiment according to the present invention which is substantially the same as the first embodiment except for the position of switch 50*a* and the structure of limiting member 60.

Specifically, control groove 24*a* in the second embodiment is defined in first side 211 and in communication with second compartment 23. Furthermore, control groove 24*a* surrounds first compartment 22 and has an axis coaxial to rotating axis CL.

First pawl 41 includes a first push face 413 corresponding to the position of control groove 24*a*. Second pawl 42 includes a second push face 423 corresponding to the position of control groove 24*a*.

Switch 50*a* is hollow and annular and includes an axial hole 56 rotatably receiving drive member 30, such that switch 50*a* is rotatable relative to drive member 30 between the first, second, and third positions. When switch 50*a* is in the first position, first pawl 41 is disengaged from drive member 30, and second pawl 42 is engaged with drive member 30. When switch 50*a* is in the second position, second pawl 42 is disengaged from drive member 30, and first pawl 41 is engaged with drive member 30. When switch 50*a* is in the third position, both first and second pawls 41 and 42 are engaged with drive member 30.

Switch 50*a* includes first and second actuating portions 51*a* and 52*a* extending into second compartment 23 to control pawl device 40 in second compartment 23. When switch 50*a* is pivoted to the first position, first pawl 41 is moved by first actuating portion 51*a* to disengage from drive member 30. In this case, pawl device 40 is in the first engagement relation with drive member 30, and head 21 can rotate together with drive member 30 in the first driving direction and can rotate freely relative to drive member 30 in a second driving direction opposite to the first driving direction. When switch 50*a* is pivoted to the second position, second pawl 42 is moved by second actuating portion 52*a* to disengage from drive member 30. In this case, pawl device 40 is in the second engagement relation with drive member 30, and head 21 can rotate together with drive member 30 in the second driving direction and can rotate freely relative to drive member 30 in the first driving direction.

First push face 413 of first pawl 41 can be selectively actuated by first actuating portion 51*a*, and second push face 423 of second pawl 42 can be selectively actuated by second actuating portion 52*a*. First and second actuating portions 51*a* and 52*a* are arcuate and slideable in the annular control groove 24*a* in a circumferential direction about rotating axis CL. First actuating portion 51*a* has a thickness larger than a tooth height of first toothed section 411 of first pawl 41. Thus, first pawl 41 can be separated and disengaged from drive member 30 by first actuating portion 51*a*. Nevertheless, elastic element 43 biases first push face 413 of first pawl 41 to press against first actuating portion 51*a* and biases first pawl 41 to press against first abutment face 231, providing a reliable and stable driving effect for first pawl 41. Second actuating portion 52*a* operates in a similar manner and is, thus, not described in detail to avoid redundancy.

An open section 53*a* is formed between first and second actuating portions 51*a* and 52*a*. When switch 50*a* is in the third position, first push face 413 of first pawl 41 and second push face 423 of second pawl 42 are received in open section 53*a* of switch 50*a*. First and second pawls 41 and 42 are both engaged with drive member 30, preventing drive member 30 from rotating relative to head 21. Thus, body 20 can be rotated to jointly rotate driving portion 30 of drive member 30 and head 21 in either of the first and second driving directions.

A stop 64 is formed between the first and second ends of limiting member 60 to prevent excessive movement of first follower portion 412 of first pawl 41, avoiding damage to elastic element 43 due to excessive compression. Likewise, stop 64 prevents excessive movement of second follower portion 422 of second pawl 42, avoiding damage to elastic element 43 due to excessive compression.

Figure 8A:
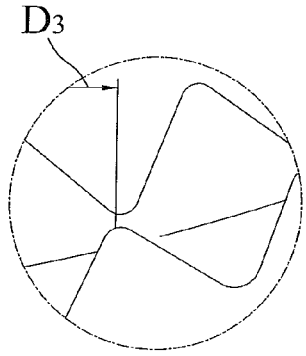
FIG. 8A shows an enlarged view of a circled portion of FIG. 8.
Figure 8:
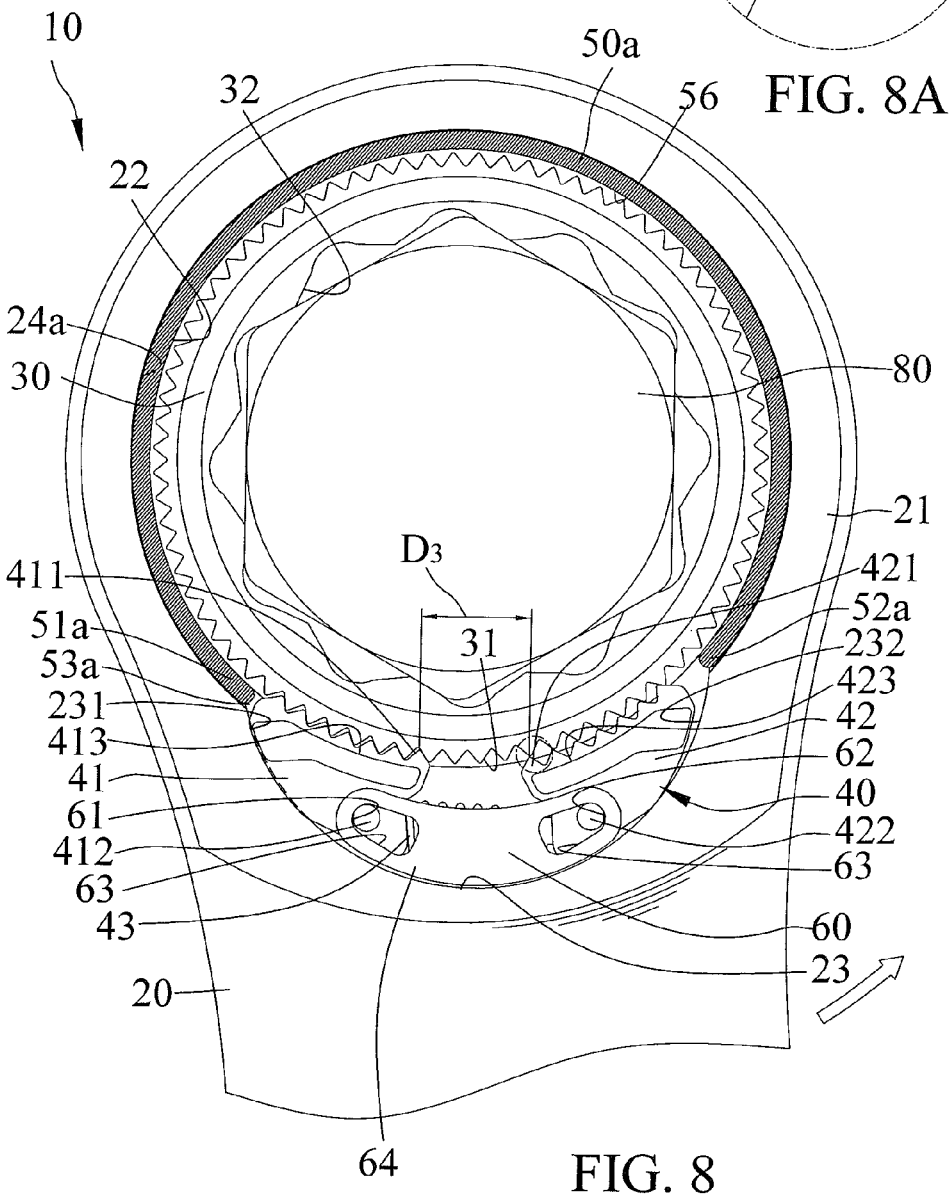
FIG. 8 shows a cross sectional view of the ratchet wrench of FIG. 6, with the limiting member keeping two closest teeth respectively of two pawls of the pawl device to be within a stuck tooth number spacing.

With reference to FIG. 8, when body 20 is rotated in a counterclockwise direction to drive a tightened fastener 80 while switch 50*a* is in the third position, the reactive force from fastener 80 causes drive member 30 to actuate first pawl 41 to press against first abutment face 231 of second compartment 231, causing deformation of first abutment face 231. First limiting portion 61 of limiting member 60 is actuated by first follower portion 412 to move together with first pawl 41. At the same time, second limiting portion 62 of limiting member 60 actuates second follower portion 422 of second pawl 42, causing movement of second pawl 42 without moving switch 50*a*. Thus, second pawl 42 is disengaged from toothed portion 31 of drive member 30.

Since restraining spacing D3 is smaller than jam spacing D2, limiting member 60 prevents simultaneous jam of first and second pawls 41 and 42 between drive member 30 and the wall of second compartment 23, effectively avoiding pawl device 40 from the jammed state. Thus, the wall of second compartment 23 restitutes to its original shape shown in FIG. 7 when body 20 is not rotated. Elastic element 43 biases first pawl 41 to press against first abutment face 231 and to engage with drive member 30 and biases second pawl 42 to press against second abutment face 232 and to engage with drive member 30. Nevertheless, first and second pawls 41 and 42 are disengageable from drive member 30. Pawl device 40 is returned to the stable state.

Figure 9:
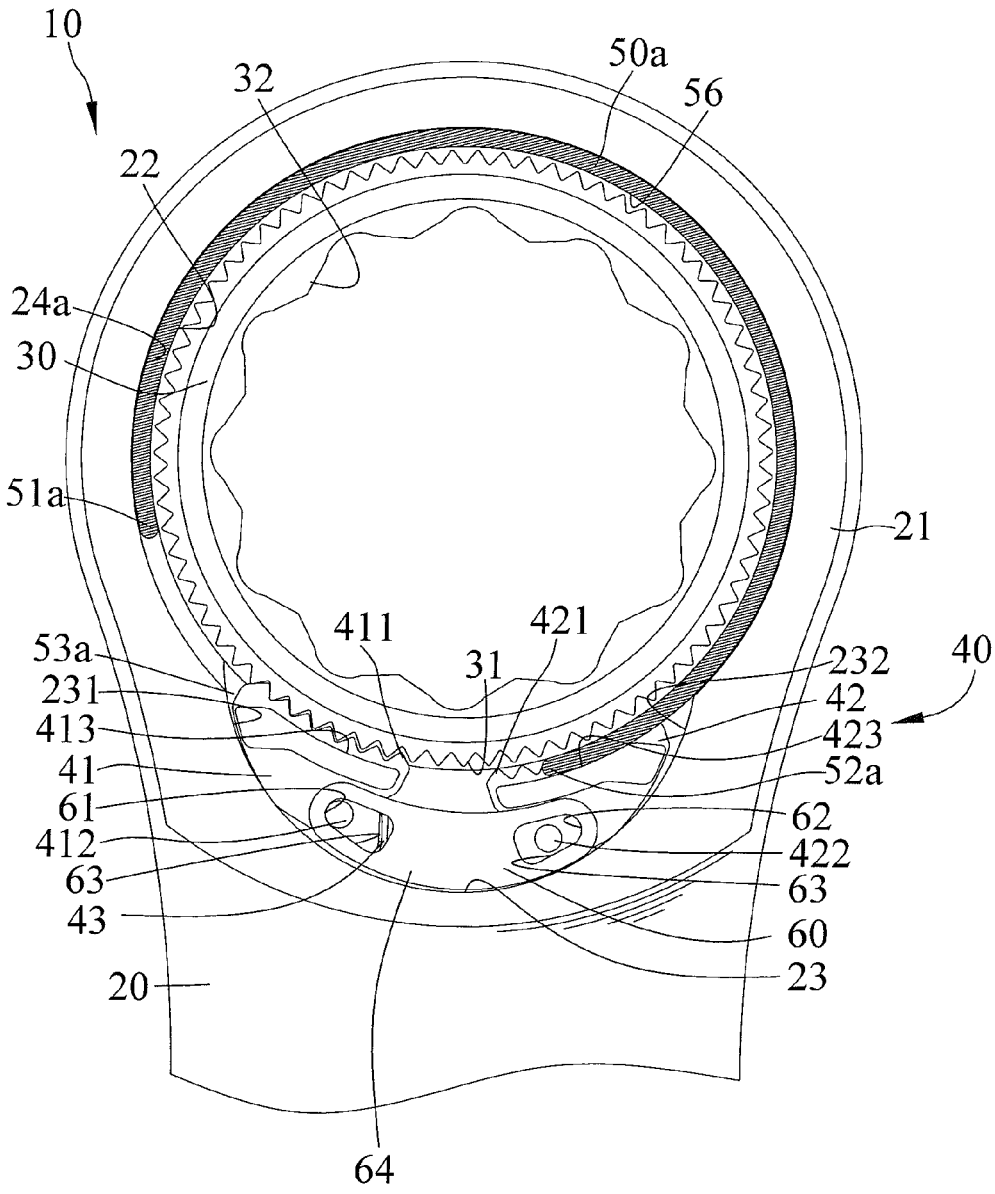
FIG. 9 shows a view similar to FIG. 8, with a switch moved to another position.
Figure 10:
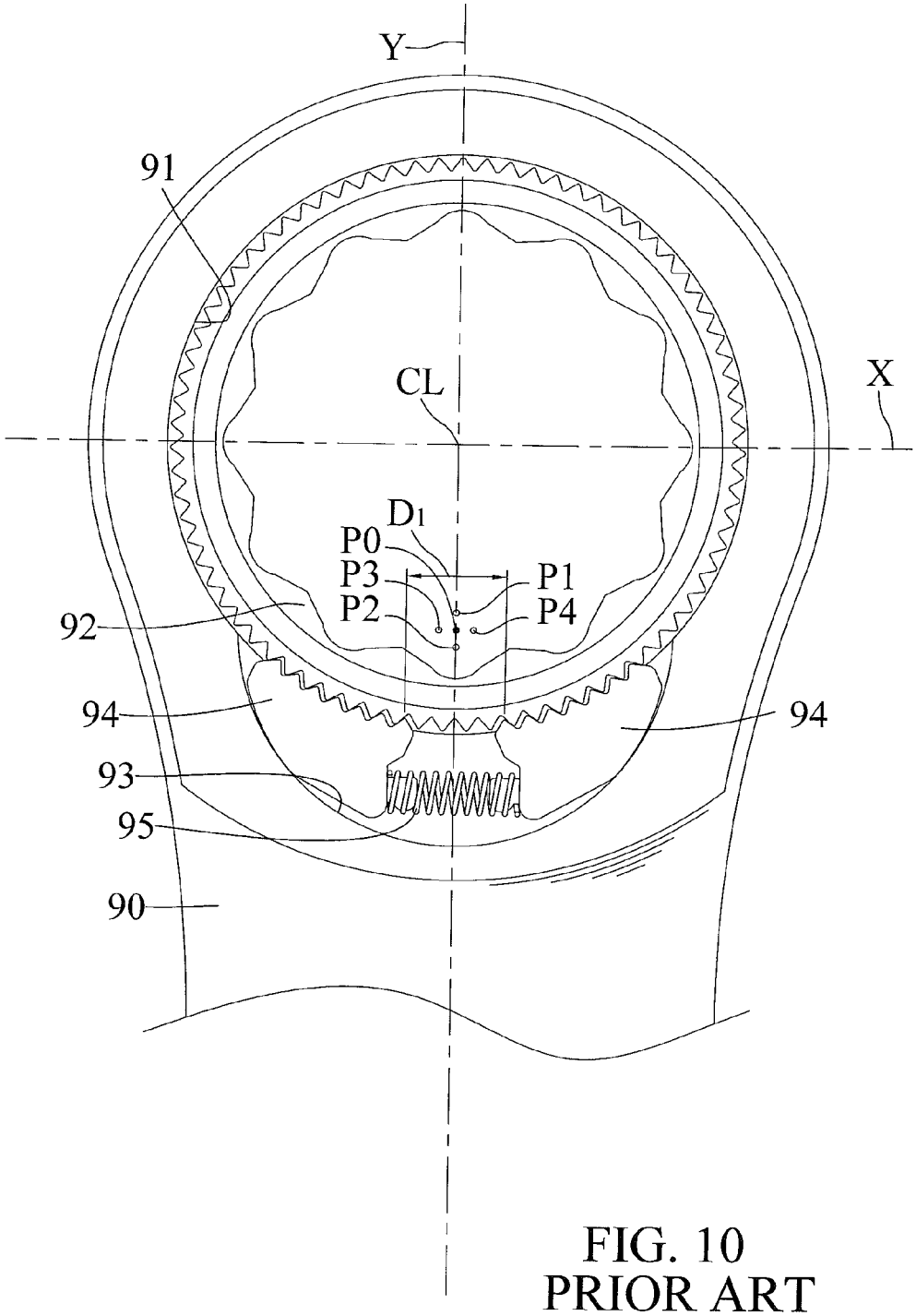
FIG. 10 PRIOR ART
FIG. 10 shows a partial, cross sectional view of a conventional ratchet wrench.
Figure 11:
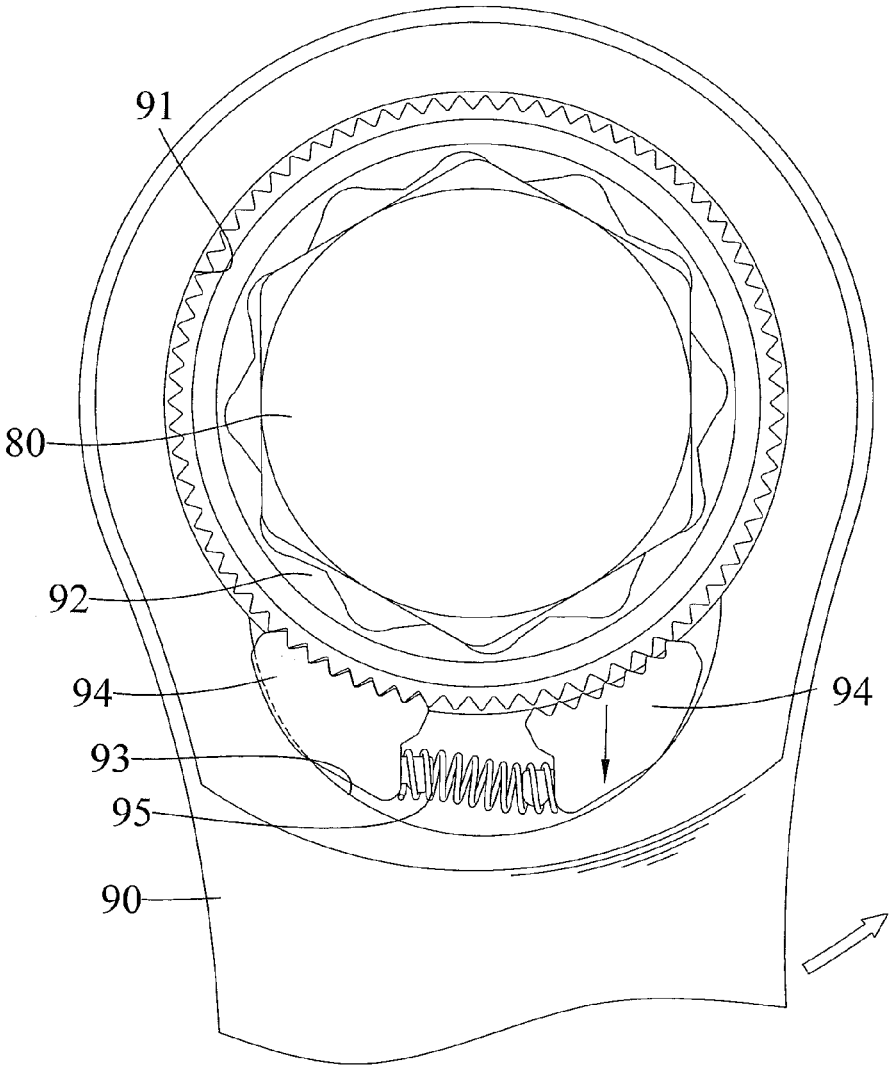
FIG. 11 PRIOR ART
FIG. 11 shows a view similar to FIG. 10, with the ratchet wrench rotated counterclockwise.
Figure 12:
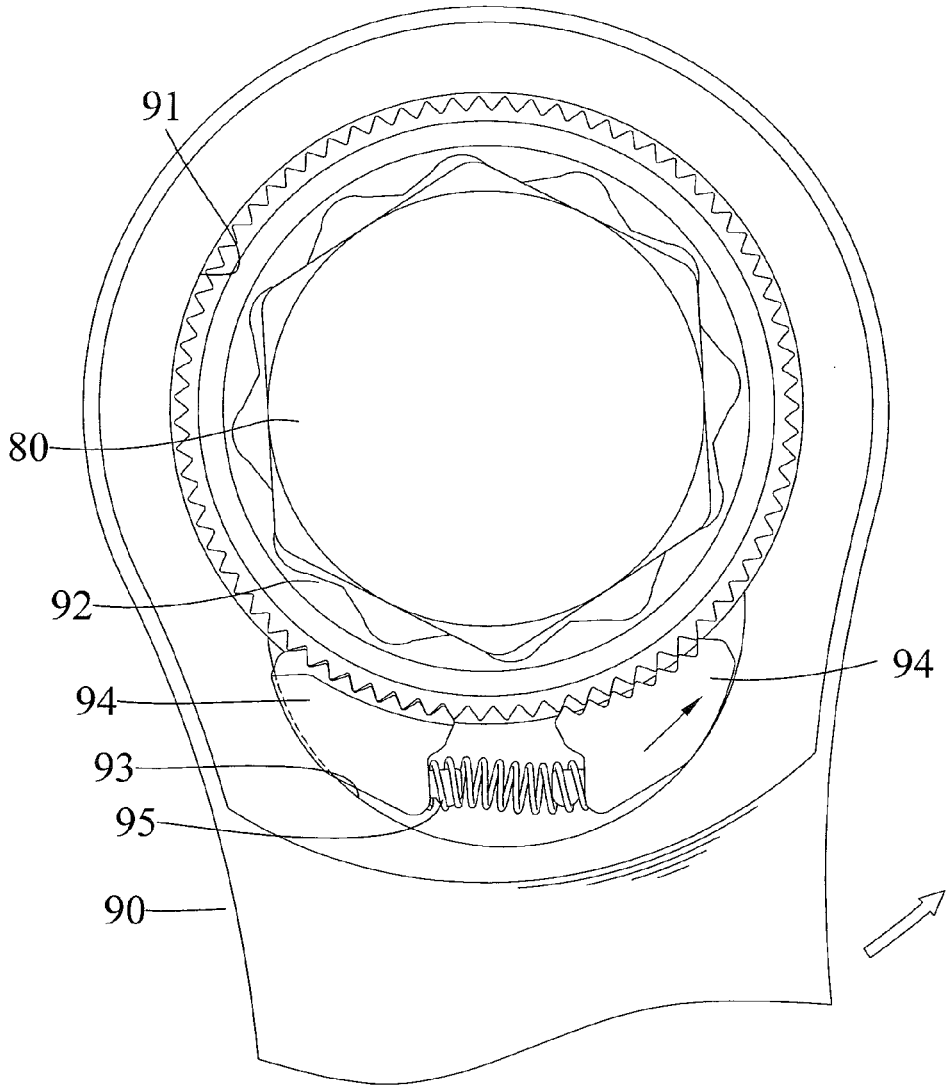
FIG. 12 PRIOR ART
FIG. 12 shows a view similar to FIG. 11, with a right pawl pushed away from a left pawl.

With reference to FIG. 9, switch 50*a* can be pivoted to change the positions of first and second pawls 40 when pawl device 40 is in the stable state, effectively avoiding jam resulting from processing errors.

If desired, switch 50 can include only two positioning portions 55, such that pawl device 40 can be selectively engageable with drive member 30 in either of first and second engagement relations corresponding to the first and second driving directions of ratchet wrench 10 driving fastener 80.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A ratchet wrench comprising:

a body including a head having an inner periphery defining a first compartment, with a second compartment defined in the inner periphery of the head and including a wall, with the head including a control groove in communication with the second compartment;

a drive member rotatably received in the first compartment of the head, with the drive member including an annular toothed portion formed on an outer periphery thereof, with the drive member adapted to drive a fastener to rotate;

a pawl device mounted in the second compartment of the head, with the pawl device selectively engageable with the drive member in either of first and second engagement relations corresponding to first and second driving directions of the ratchet wrench driving the fastener, with the pawl device including first and second pawls and an elastic element mounted between the first and second pawls, with the elastic element biasing the first and second pawls away from each other, with the first pawl including a first toothed section, with the first toothed section engageable with the toothed portion of the drive member under bias of the elastic element, with the second pawl including a second toothed section, with the second toothed section engageable with the toothed portion of the drive member under the bias of the elastic element, with the pawl device movable between a stable state in which the first and second toothed sections of the first and second pawls are disengageable from the toothed portion of the drive member and a jammed state in which the first and second toothed sections of the first and second pawls jam between the toothed portion of the drive member and the wall of the second compartment, wherein two closest teeth respectively of the first and second toothed sections have a safety spacing therebetween when the pawl device is in the stable state, and wherein the two closest teeth respectively of the first and second toothed sections have a jam spacing therebetween when the pawl device is in the jammed state;

a switch pivotably mounted in the control groove and operatively connected to the pawl device, with the switch controlling the pawl device to be in one of the first and second engagement relations with the drive member; and a limiting member comprising a loop being connected between the first and second pawls, with the limiting member maintaining the two closest teeth respectively of the first and second toothed sections to be in a restraining spacing, with the restraining spacing smaller than the jam spacing, preventing the pawl device from the jammed state.

2. The ratchet wrench as claimed in claim 1, with the limiting member including a first limiting portion and a second limiting portion, with the first pawl including a first follower portion, with the second pawl including a second follower portion, with the first limiting portion connected to the first follower portion, with the second limiting portion connected to the second follower portion.

3. The ratchet wrench as claimed in claim 2, with the limiting member including a sliding groove having first and second ends respectively forming the first and second limiting portions, with the first and second follower portions of the first and second pawls slideably received in the sliding groove.

4. The ratchet wrench as claimed in claim 3, wherein when the first follower portion of the first pawl actuates the first limiting portion of the limiting member and causes movement of the limiting member, the second limiting portion of the limiting member actuates the second follower portion of the second pawl to cause movement of the second pawl, maintaining the two closest teeth respectively of the first and second toothed sections to be in the restraining spacing without driving the switch.

5. The ratchet wrench as claimed in claim 4, with the limiting member further including a stop between the first and second ends of the sliding groove.

6. The ratchet wrench as claimed in claim 1, with the restraining spacing equal to or larger than the safety spacing.

7. The ratchet wrench as claimed in claim 1, with the switch movable between first, second, and third positions, with the switch including a first actuating portion and a second actuating portion, wherein when the switch is moved to the first position, the first pawl is moved by the first actuating portion to disengage from the drive member, the second pawl is engaged with the drive member, the pawl device is in the first engagement relation with the drive member, wherein when the switch is moved to the second position, the second pawl is moved by the second actuating portion to disengage from the drive member, the first pawl is engaged with the drive member, the pawl device is in the second engagement relation with the drive member, and wherein when the switch is in the third position, the first and second pawls are engaged with the drive member, the pawl device is in a third engagement relation to the drive member, the drive member and the head rotate jointly in either of the first and second driving directions.

8. The ratchet wrench as claimed in claim 7, with the wall of the second compartment including first and second abutment faces adjacent to the first compartment and located at two sides of the second compartment, wherein when the switch is in the third position, the elastic element biases the first pawl to press against the first abutment face and to engage with the drive member, the elastic element also biases the second pawl to press against the second abutment face and to engage with the drive member, with the first and second pawls disengageable from the drive member.

9. The ratchet wrench as claimed in claim 8, with the control groove located in an end of the second compartment away from the first compartment, with the first actuating portion of the switch selectively actuating the first follower portion of the first pawl, with the second actuating portion of the switch selectively actuating the second follower portion of the second pawl, with an open section formed between the first and second actuating portions, wherein when the switch is in the third position, the first follower portion of the first pawl and the second follower portion of the second pawl are received in the open section of the switch, the first and second pawls are engaged with the drive member, preventing the drive member from rotating relative to the head of the body.

10. The ratchet wrench as claimed in claim 8, with the control groove surrounding and in communication with the first compartment, with the switch being annular and hollow and including an axial hole rotatably receiving the drive member, with the switch pivotable relative to the drive member.

11. The ratchet wrench as claimed in claim 10, with the first pawl including a first push face, with the second pawl including a second push face, with the first actuating portion of the switch selectively actuating the first push face of the first pawl, with the second actuating portion of the switch selectively actuating the second push face of the second pawl, with an open section formed between the first and second actuating portions, wherein when the switch is in the third position, the first push face of the first pawl and the second push face of the second pawl are received in the open section of the switch, the first and second pawls are engaged with the drive member, preventing the drive member from rotating relative to the head of the body.

12. The ratchet wrench as claimed in claim 8, further comprising a positioning device between the switch and the body, with the switch including a plurality of positioning portions, with the body further including a groove receiving the positioning device, with the positioning device including an elastic member received in the groove and a positioning member between the elastic member and the switch, with the elastic member biasing the positioning member to be selectively engaged with one of the plurality of positioning portions of the switch.

13. The ratchet wrench as claimed in claim 12, with the head of the body defining a rotating axis, with the head including a first side and a second side parallel to the first side and spaced from the first side along the rotating axis, with the first compartment extending from the first side through the second side along the rotating axis, with the drive member rotatable relative to the head about the rotating axis.

* * * * *